US007109839B2

(12) United States Patent
Etschmaier et al.

(10) Patent No.: US 7,109,839 B2
(45) Date of Patent: Sep. 19, 2006

(54) FUSE LINK, METHOD FOR THE PRODUCTION THEREOF AND SOLDERING SUBSTANCE

(75) Inventors: Alexander Etschmaier, Leoben (AT); Helmut Wieser, Neutraubling (DE)

(73) Assignee: Siemens Aktiengesellschaft, Munich (DE)

( * ) Notice: Subject to any disclaimer, the term of this patent is extended or adjusted under 35 U.S.C. 154(b) by 119 days.

(21) Appl. No.: 10/380,238

(22) PCT Filed: Sep. 11, 2001

(86) PCT No.: PCT/EP01/10499

§ 371 (c)(1),
(2), (4) Date: Mar. 13, 2003

(87) PCT Pub. No.: WO02/23575

PCT Pub. Date: Mar. 21, 2002

(65) Prior Publication Data

US 2004/0027226 A1 Feb. 12, 2004

(51) Int. Cl.
*H01H 85/11* (2006.01)
*H01H 85/06* (2006.01)

(52) U.S. Cl. ..... 337/160; 337/152; 337/296

(58) Field of Classification Search ..... 337/290, 337/296, 295, 297, 159, 160, 416, 152; 29/623; 420/562, 571, 572, 576, 577, 580, 589; 148/433, 148/400, 442

See application file for complete search history.

(56) References Cited

U.S. PATENT DOCUMENTS 2,703,352 A 3/1955 Kozacka
3,236,976 A * 2/1966 Rayno ..... 337/292
3,627,517 A 12/1971 Ibscher
5,752,310 A * 5/1998 Kondo et al. ..... 29/623
5,821,847 A * 10/1998 Totsuka ..... 337/166
6,064,293 A * 5/2000 Jungst et al. ..... 337/290
6,075,434 A 6/2000 Rueckling
6,160,471 A * 12/2000 Rybka et al. ..... 337/278
6,222,438 B1 * 4/2001 Horibe et al. ..... 337/290
6,570,482 B1 * 5/2003 Brown et al. ..... 337/160
6,791,448 B1 * 9/2004 Kaltenborn et al. ..... 337/160

FOREIGN PATENT DOCUMENTS

DE 2551627 6/1977
GB 840655 7/1960
JP 2000073154 A * 3/2000
JP 2001325867 A * 11/2001

* cited by examiner

*Primary Examiner*—Anatoly Vortman
(74) *Attorney, Agent, or Firm*—Harness, Dickey & Pierce, P.L.C.

(57) ABSTRACT

A fuse link, especially for low voltage, high-breaking-capacity fuses, includes at least one fusible conductor having a soldering substance in a solder depot of a carrier, the solder being tin-based and the carrier being copper-based. The solder contains a tin alloy as an active substance, the tin alloy having two other constituents. The first constituent, which is the larger of the two in weight percent but which is smaller in weight percent than the proportion of the base substance tin, is selected for lowering the fusion temperature of the solder. The second constituent, which is the smaller of the two in weight percent, is a substance which does not dissolve in tin. Crystal nuclei are formed when said substance is cooled from the liquid state to the solid state, creating a fine structure and preventing the structure from becoming coarse under a load.

27 Claims, 3 Drawing Sheets

SnBiCu 25 0,8

SnBi 75 25

FUSE LINK, METHOD FOR THE PRODUCTION THEREOF AND SOLDERING SUBSTANCE

This application is the national phase under 35 U.S.C. § 371 of PCT International Application No. PCT/EP01/10499 which has an International filing date of Sep. 11, 2001, which designated the United States of America and which claims priority on European patent application number EP 00119932.2 filed Sep. 13, 2000, the entire contents of which are hereby incorporated herein by reference.

FIELD OF THE INVENTION

The invention generally relates firstly to a fuse link. In particular, it relates to one for low-voltage high-breaking-capacity fuses, LV HBC fuses, which has at least one fusible conductor with a solder substance in a solder deposit of a support. The solder is preferably based on tin and the support is preferably based on copper.

BACKGROUND OF THE INVENTION

In the fuse links which are available on the market, the solder substance is usually a tin-cadmium alloy. SnCd 80 20, i.e. an alloy comprising 80% by weight of tin and 20% by weight of cadmium, is customary. Recently, however, there has been a desire to avoid cadmium, for reasons of environmental protection. There are fuse links on the market in which the fusible conductors include a solder substance comprising SnBi 95 5. In these, the fusing times of the fusible conductors provided with this solder are subject to a considerably wider scatter than those which use the conventional SnCd solders.

SnBi solders generally tend to flow. To prevent this, in a fuse link which is commercially available, the solder has been covered with a layer which contains silicone. In this case, the arcing performance of the fuse link may deteriorate considerably when the silicone breaks down, on account of the carbon atoms.

The fusible conductor and solder system is generally to be configured in such a way that in the event of prolonged overload currents the solder melts locally, dissolves the material of its support, i.e. the fusible conductor and thereby accelerates switching off. In this context, one generally refers to a M effect. The solder should satisfy the following conditions:

- Sufficient solubility of the solder substance with regard to the fusible conductor material, generally copper,
- no flow of the solder during fusing,
- solder bridges between the ends of the fused fusible conductor should be avoided.

An organic coating has already been provided as a solder stopping agent which is intended to prevent the solder from flowing in the event of a solder substance which does not include cadmium. Although it is in this way possible to prevent solder substances without cadmium from flowing, the thermal decomposition of the organic matrix during fusing of the fusible conductor, i.e. in order to break the fuse, may lead to the formation of an electrically conductive plastic film, which may prevent the circuit from being broken.

The problem of flow has existed since the start of attempts to use cadmium-free solders.

SUMMARY OF THE INVENTION

An embodiment of the invention may be based firstly on an object of developing a fuse link which works with a cadmium-free solder on the fusible conductor and in which the problems which have been outlined, in particular the scatter in the breaking values and the flow of the solder, are improved in such a way that the otherwise good properties of cadmium-containing fusible conductor systems are achieved.

According to an embodiment of the invention, the solder contains, as active substance, a tin alloy with two further constituents, a first constituent of which there is a higher content in percent by weight but a lower content in percent by weight than the content of the base substance tin, then being selected so as to reduce the melting point of the solder. A second constituent, of which there is a lower content in percent by weight, is a substance which is not soluble in the tin, with the result that during cooling from the liquid state to the solid state, crystallization nuclei are formed, producing a fine microstructure and preventing the microstructure from being coarsened when a load is applied to the fuse. A fusible conductor/solder system of this type can be adapted to have a similar scatter as if cadmium were used and suitable response times. The fine microstructure apparently promotes the dissolution of the support material, i.e. the fusible conductor, with the result that the same fusing times and a similar fusing performance to those of fusible conductors with conventional cadmium-containing fusible conductor solders are achieved. The fusing operation is consequently not exposed to separate energy conversion, and consequently there is no need for additional heating.

An embodiment of the invention is based on the further object of further developing a cadmium-free fuse link in such a way that the flow of the solder is reduced. According to an embodiment, the solder, as solder material in the solder deposit of a support, and/or the support is provided with an oxide skin. The oxide skin may be formed thermally or chemically. It is sufficient for the oxide skin to be formed in the boundary region between solder and support. In practice, in view of the standard geometric configurations, it is also possible for the wetting of the support in the region of the solder or in the vicinity thereof to be controlled in a desired way by means of the geometry of the oxidized regions.

An embodiment of the invention also relates to a process for producing a fuse link, according to which solder and/or support are subjected to a heat treatment in an oxidizing atmosphere. Furthermore, there is a process for producing a fuse link, according to which the solder and/or the support is treated with a substance which has an affinity for the solder and/or support. A sodium sulfide solution is particularly suitable for this purpose.

A substance which has an affinity for the solder and/or support may be applied between absorbent rolls which have been impregnated with the substance having the affinity.

Finally, at least one of the objects which have been set may be achieved, according to an embodiment of the invention, by a solder material consisting of a tin-bismuth-copper alloy, a tin-indium-copper alloy or a tin-bismuth-iron alloy. A solder material which includes a tin-bismuth-copper alloy comprising 10% to 30% of bismuth and 0.3% to 1.0% of copper, which together with tin amount to 99.5%, remainder standard impurities, has proven particularly advantageous.

BRIEF DESCRIPTION OF THE DRAWINGS

The invention will now be explained in more detail with reference to the drawings and with reference to examples.

DETAILED DESCRIPTION OF THE PREFERRED EMBODIMENTS

Figure 1:
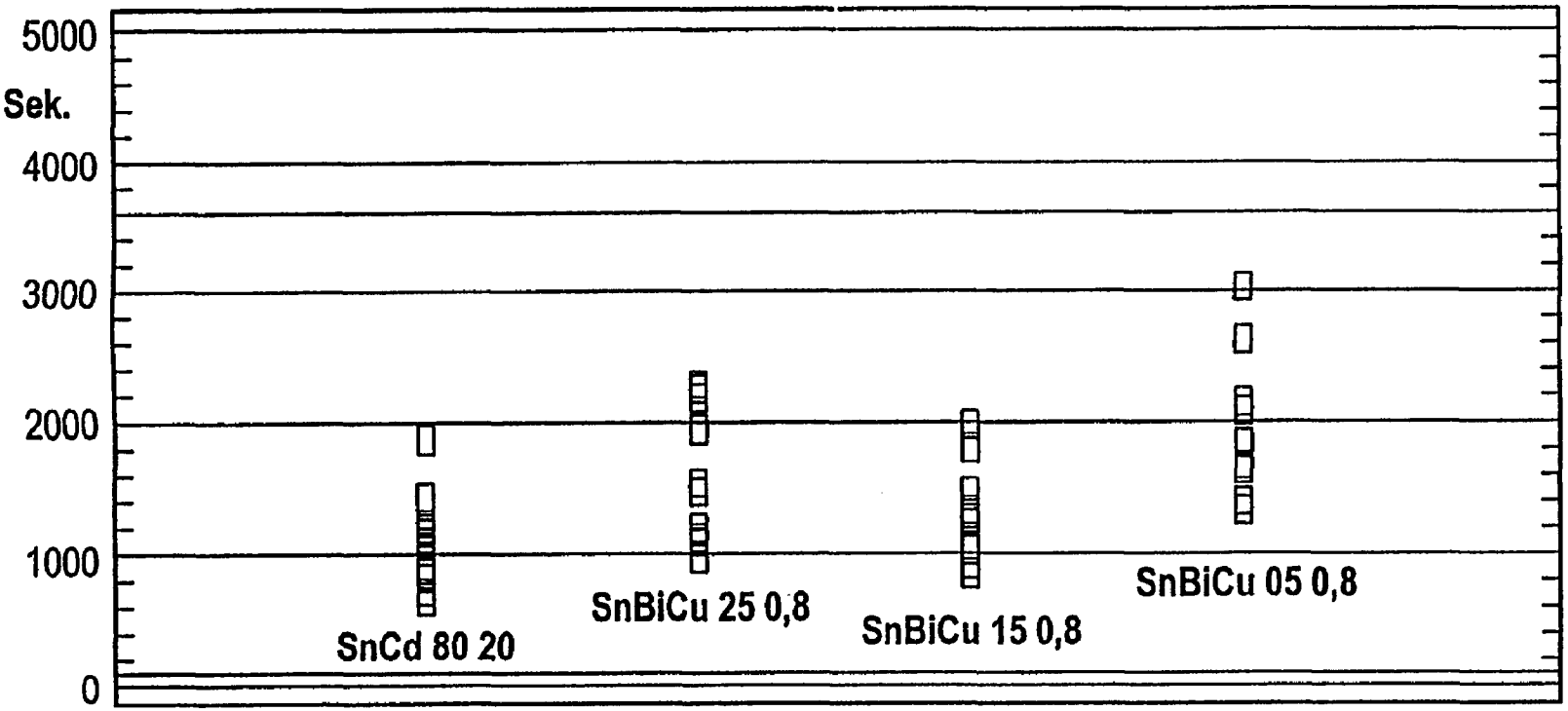
In FIG. 1, fusing tests are plotted in a diagram, the left-hand part of the figure illustrating, for comparison purposes, the breaking performance of a standard tin-cadmium solder substance over a plurality of tests in accordance with the prior art. The series of tests which follow on the right-hand side of the figure illustrate the breaking performance of tin-bismuth-copper with various proportions of these elements.
Figure 3:
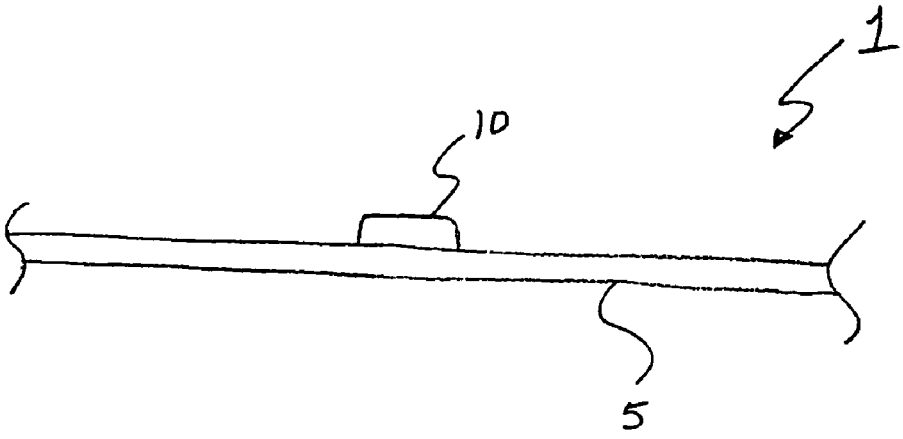
FIG. 3 is a schematic view of a fusible conductor according to an example, non-limiting embodiment of the invention.

In the diagram shown in FIG. 1, the response tie of the fusible conductor 1 (see FIG. 3) in seconds until it breaks is plotted on the ordinate, and tin alloys having the constituents and contents indicated are plotted on the abscissa. The results over the plurality of tests have been plotted. Copper was used as support 5 for the solder 10 (see FIG. 3). Tin-cadmium serves as an orientation value. In the cadmium-free alloys, bismuth contents in percent by weight of 25%, 15% and 5% have been investigated, in each case with a load of 32 A phase current, in this case equivalent to 1.6 times the rated current. The copper contents are in each case 0.8%. The tin content makes up the difference to 99.5%, the remainder being composed of standard impurities.

The first further constituent of the tin alloy is present in a smaller amount than the amount of the base substance. This constituent reduces the melting point of the solder. In the present case, bismuth was used for this substance. A second constituent, of which there is a smaller amount in percent by weight, is a substance which is insoluble in the tin, with the result that during cooling from the liquid state to the solid state, crystallization nuclei are formed, producing a fine microstructure. Copper was used for this purpose. The scatter in the corresponding alloy can be seen from the diagram shown in FIG. 1, and the time until response and until the circuit is broken for a specific geometry of the fusible conductor, with a narrow point in front of the solder, can also be seen from the diagram shown in FIG. 1. For an intended current load and when a specific alloy is used for the solder, these times can be influenced considerably by the geometry of the fusible conductor and if appropriate the nature and dimensions of a narrow point in front of the solder.

Fuse links having a solder substance in the fusible conductor comprising tin-bismuth-copper alloy, comprising tin-indium-copper alloy or comprising tin-bismuth-iron alloy have proven particularly suitable.

A tin alloy which contains from 3% to 40% of bismuth and from 0.3% to 5.0%, in ach case percent by weight, of copper has proven particularly favorable. Overall, tin makes up the difference to 99.5%, with the remainder being standard impurities.

A tin-indium-copper alloy having the following constituents in percent by weight: from 70% to 96% of Sn, from 3% to 30% of In, from 0.3% to 5.0% of Cu, has proven favorable.

Among tin-bismuth-copper alloys, those whose contents, in each case in percent by weight, are within the following range have proven particularly favorable:

from 89% to 96% of Sn, from 3% to 10% of Bi, and from 0.8% to 2.3% of Cu.

Among tin-bismuth-copper alloys, those which have the following contents in percent by weight have proven to exhibit particularly little scatter and to have a response performance which is particularly advantageous in practice:

from 69% to 89% of Sn, from 10% to 30% of Bi, from 0.3% to 1.0% of Cu.

Total 99.5%, remainder standard impurities.

Figure 2:
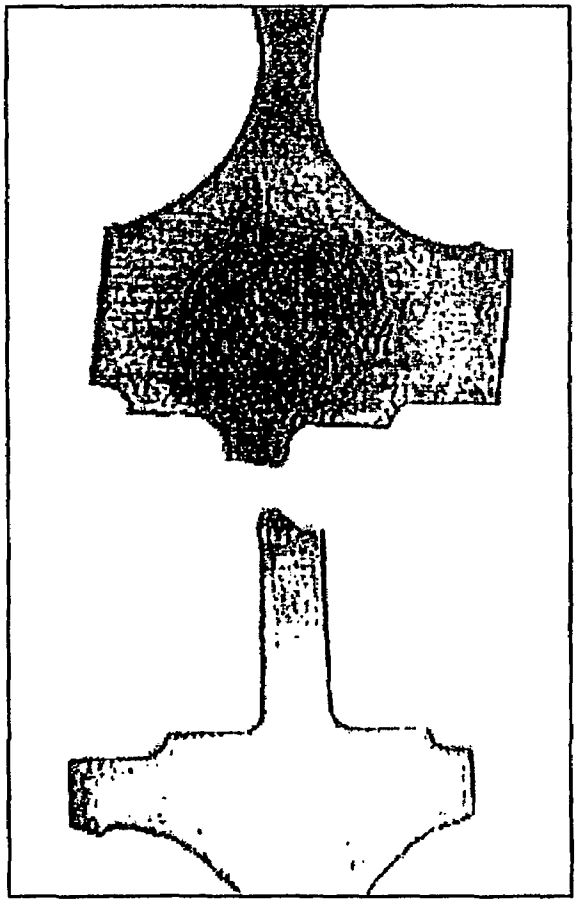
FIG. 2 shows a comparison, on the left-hand side for cadmium-free solder without copper, and on the right-hand side for an exemplary embodiment according to an embodiment of the invention with cadmium-containing solder and tin-bismuth with copper, of in each case one fusible conductor with a narrow point in front of a solder deposit after the fusible conductor has responded and with a broken fusible conductor.
Figure 2:
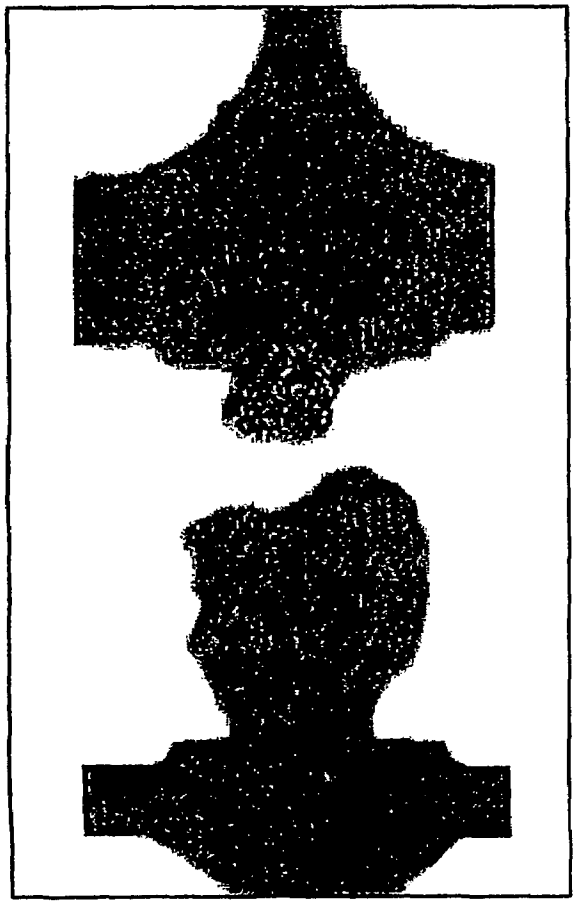

FIG. 2 shows, for a fusible link of identical geometric configuration, a broken narrow point in front of the solder deposit, in each case on an enlarged scale, the maximum width of the fusible conductor in its normal state amounting to 14 mm. The left-hand part of the illustration used for comparison purposes, in a copper fusible conductor, a tin-bismuth solder comprising approximately 75% of tin and 25% of bismuth. The right-hand part of FIG. 2 shows, for a tin-bismuth-copper alloy with 25% of bismuth and 0.8% of copper and a tin content of 73.7%, total 99.5%, with 0.5% of standard impurities, the situation after the fusible conductor has been broken as a result of the action of the solder. One can see that solder and attacked fusible conductor, in microsection, have a fine microstructure and clean contours. The conversion of energy during fusing of the fusible conductor is therefore kept at a low level and the formation of heat cracks is avoided.

The performance of the three-material alloys provided can be improved further by an oxide skin on the solder in the solder deposit and/or on the fusible conductor, at least in the vicinity of the solder deposit. An oxide skin of this type can be used to prevent the melting solder from flowing when the fusible conductor in the fuse link responds. This measure of targeted deployment of an oxide skin can be used as a general measure for solders which are not inherently able to retain their position, irrespective of the general structure of the solder or the alloy used as solder.

An oxide skin of this type may be formed thermally or chemically. For thermal oxidation, the solder and/or the support can be treated in an oxidizing atmosphere. It is possible to use a targeted local action of heat, for example by use of a flame.

Substances which have an affinity for the solder or for the support are suitable for a chemical treatment. For example, in the case of a support based on copper, the fusible conductor can be treated with a sodium sulfide solution. In the most simple case, this can be achieved by brushing on the substance or by means of absorbent rolls which are impregnated with the substance which has the affinity and roll over the fusible conductor at the desired point. To prevent the solder from flowing in an even more reliable way, it is sufficient to perform oxidation only in the region of the solder and the adjoining regions of the support.

Cadmium-free solder materials for fuse links may advantageously be a tin-bismuth-copper alloy, a tin-indium-copper alloy or a tin-bismuth-iron alloy. In this context, it is favorable, irrespective of a geometric configuration of the fusible conductor, if the following contents are present, in each case in percent by weight:

10% to 30% of bismuth, 0.3% to 1.0% of copper, total with tin 99.5%, remainder impurities.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fuse link, comprising:

at least one fusible conductor including a solder provided on only a portion of a support, the solder being based on tin and the support being based on copper, wherein the solder contains a tin alloy with a first constituent and a second constituent;

wherein the first constituent is present at a higher content in percent by weight than the second constituent, is present at a at a lower content in percent by weight than the tin, and is selected to reduce the melting point of the solder; and wherein the second constituent is not soluble in the tin so that during cooling of the fusible conductor from the liquid state to the solid state, crystallization nuclei which produce a fine microstructure are formed.

2. The fuse link as claimed in claim 1, wherein the solder is at least one of a tin (Sn)-bismuth (Bi)-copper (Cu) alloy, a tin (Sn)-indium (In)-copper (Cu) alloy and a tin (Sn)-bismuth (Bi)-iron (Fe) alloy.

3. The fuse link as claimed in claim 2, wherein the solder is a tin (Sn)-bismuth (Bi)-copper (Cu) alloy which contains the following constituents in percent by weight: from 60% to 96% of Sn, from 3% to 40% of Bi, from 0.3% to 5.0% of Cu, total 99.5%, remainder standard impurities.

4. The fuse link as claimed in claim 2, wherein the solder is a tin (Sn)-indium (In)-copper (Cu) alloy which contains the following constituents in percent by weight: from 70 to 96% of Sn, from 3% to 30% of In, from 0.3% to 5.0% of Cu, total 99.5%, remainder standard impurities.

5. The fuse link as claimed in claim 3, wherein the solder is a tin (Sn)-bismuth (Bi)-copper (Cu) alloy, comprising the following constituents in percent by weight: from 89% to 96% of Sn, from 3% to 10% of Bi, from 0.8% to 2.3% of Cu, total 99.5%, remainder standard impurities.

6. The fuse link as claimed in claim 3, wherein the solder is a tin (Sn)-bismuth (Bi)-copper (Cu) alloy, comprising the following constituents in percent by weight: from 69% to 89% of Sn, from 10% to 30% of Bi, from 0.3% to 1.0% of Cu, total 99.5%, remainder standard impurities.

7. A fuse link as claimed in claim 1, wherein the support is provided with an oxide skin.

8. The fuse link as claimed in claim 7, wherein the oxide skin is formed thermally.

9. The fuse link as claimed in claim 7, wherein the oxide skin is formed chemically.

10. A process for producing the fuse link as claimed in claim 9, comprising:

subjecting at least one of the solder and the support to a heat treatment in an oxidizing atmosphere.

11. A process for producing the fuse link as claimed in claim 9, wherein the fusible conductor includes a solder material in a solder deposit of a support, comprising:

treating at least one of the solder and the support with a substance which has an affinity for at least one of the solder and support.

12. The process as claimed in claim 11, comprising:

treating the fusible conductor with a sodium sulfide solution.

13. The process as claimed in claim 11, wherein a substance which has an affinity for at least one of the solder and support takes place between absorbent rolls which have been impregnated with the substance having the affinity.

14. The process as claimed in claim 10, wherein the oxidation is formed only in the region of the solder and the adjoining regions of the support.

15. A solder for a fuse link as claimed in claim 1, consisting of at least one of a tin (Sn)-bismuth (Bi)-copper (Cu) alloy, a tin (Sn)-indium (In)-copper (Cu) alloy or a tin (Sn)-bismuth (Bi)-iron (Fe) alloy.

16. The solder as claimed in claim 15, wherein a tin (Sn)-bismuth (Bi)-copper (Cu) alloy contains the elements in the following percentages by weight: 10% to 30% of Bi, 0.3% to 1.0% of Cu, total with tin 99.5%, remainder standard impurities.

17. A fuse link as claimed in claim 1, wherein the fuse link is for a low-voltage high-breaking-capacity fuse (LV HBC fuse).

18. The process as claimed in claim 12, wherein a substance which has an affinity for at least one of the solder and support takes place between absorbent rolls which have been impregnated with the substance having the affinity.

19. The process as claimed in claim 11, wherein the oxidation is formed only in the region of the solder and the adjoining regions of the support.

20. The process as claimed in claim 12, wherein the oxidation is formed only in the region of the solder and the adjoining regions of the support.

21. The process as claimed in claim 13, wherein the oxidation is formed only in the region of the solder and the adjoining regions of the support.

22. A solder for a fuse link as claimed in claim 2, consisting of at least one of a tin (Sn)-bismuth (Bi)-copper (Cu) alloy, a tin (Sn)-indium (In)-copper (Cu) alloy and a tin (Sn)-bismuth (Bi)-iron (Fe) alloy.

23. A solder for a fuse link as claimed in claim 7, consisting of at least one of a tin (Sn)-bismuth (Bi)-copper (Cu) alloy, a tin (Sn)-indium (In)-copper (Cu) alloy or a tin (Sn)-bismuth (Bi)-iron (Fe) alloy.

24. The solder as claimed in claim 22, wherein a tin (Sn)-bismuth (Bi)-copper (Cu) alloy contains the elements in the following percentages by weight: 10% to 30% of Bi, 0.3% to 1.0% of Cu, total with tin 99.5%, remainder standard impurities.

25. The solder as claimed in claim 3, wherein a tin (Sn)-bismuth (Bi)-copper (Cu) alloy contains the elements in the following percentages by weight: 10% to 30% of Bi, 0.3% to 1.0% of Cu, total with tin 99.5%, remainder standard impurities.

26. The solder as claimed in claim 23, wherein a tin (Sn)-bismuth (Bi)-copper (Cu) alloy contains the elements in the following percentages by weight: 10% to 30% of Bi, 0.3% to 1.0% of Cu, total with tin 99.5%, remainder standard impurities.

27. A fusible conductor for a fuse link, the fusible conductor comprising:

a support; and a solder provided on only a portion of the support;

wherein the solder is an alloy including tin (Sn) present at a first percent by weight content $W_1$, one of bismuth (Bi) and indium (In) present at a second percent by weight content $W_2$, and one of copper (Cu) and iron (Fe) present at a third percent by weight content $W_3$; and wherein $W_1>W_2>W_3$.

* * * * *